US005119277A

United States Patent [19]

Copley et al.

[11] Patent Number: 5,119,277

[45] Date of Patent: Jun. 2, 1992

[54] ILLUMINATED SKATEBOARD

[75] Inventors: Michael C. Copley, La Jolla, Calif.; David R. Ekedal, 4007 Crescent Rd., Carlsbad, Calif. 92008; Kenneth D. Harris, Jr., New York, N.Y.

[73] Assignee: David R. Ekedal, San Diego, Calif.

[21] Appl. No.: 576,859

[22] Filed: Sep. 4, 1990

[51] Int. Cl.[5] ..... B60Q 1/00

[52] U.S. Cl. ..... 362/61; 362/78; 362/276; 280/87.042; 446/438

[58] Field of Search ..... 362/61, 78, 103, 276; 280/87.042, 11.18; 446/219, 438

[56] References Cited

U.S. PATENT DOCUMENTS

| | | | |
|---|---|---|---|
| 1,858,448 | 5/1932 | Johnson et al. | 446/438 |
| 2,140,224 | 12/1938 | Galgocozy | 362/103 X |
| 2,502,566 | 4/1950 | Hooley | 362/103 |
| 2,531,959 | 4/1950 | Woodard et al. | 362/103 X |
| 4,336,573 | 6/1982 | Carter | 362/78 |
| 4,367,515 | 1/1983 | Beard | 362/103 |
| 4,463,412 | 7/1984 | Broach | 362/103 X |
| 4,991,066 | 2/1991 | McCowan | 362/276 |
| 4,997,196 | 5/1991 | Wood | 280/87.042 |
| 5,004,256 | 4/1991 | Won | 280/87.042 |

*Primary Examiner*—Ira S. Lazarus
*Assistant Examiner*—Sue Hagarman

[57] ABSTRACT

An illuminated skateboard is provided which comprises a riding platform with dependent wheels, a front housing and rear housing each secured to the bottom surface of the riding platform. An illumination source in each housing is operable to provide the desired illumination while riding the skateboard.

6 Claims, 4 Drawing Sheets

ILLUMINATED SKATEBOARD

FIELD OF THE INVENTION

This invention relates generally to skateboards and is particularly related to illuminated skateboards.

BACKGROUND OF THE INVENTION

In recent years, skateboards have gained increasing popularity not only for sports and recreational purposes but for some occupations as well. For instance, messengers and couriers are using skateboards rather than other modes of transportation, and waiters and waitresses in outdoor restaurants and similar facilities are also finding it more convenient to use skateboards to quickly move about. Frequently these skateboards are used in the evenings or at night when due to poor visibility there is greater likelihood of accidents and injuries resulting from their use. In order to make the device, and hence the person riding thereon, safely visible, it has been proposed to use an illuminating device in conjunction with the skateboard. Thus, U.S. Pat. No. 4,336,573 discloses an illuminated skateboard comprising a person carrying platform under which is a pair of axles supported from the platform and rolling wheels engaged thereon. A power source is disposed on the bottom surface of the platform and is operatively connected to a light source so as to illuminate the wheels of the skateboard. The wheels are made from translucent material in order to transmit the light generated by the power source along the outer faces of the wheels.

U.S. Pat. No. 4,094,372 discloses a motorized skateboard whereby the skateboard becomes a self-propelled device. The motorized skateboard described in said patent, however, is not equipped with an illuminating means.

SUMMARY OF THE INVENTION

In accordance with this invention, an illuminated skateboard comprises a riding platform, a pair of front wheels and a pair of rear wheels, all depending from and carried by the riding platform. The front wheels and the rear wheels are rotatable about the front axle and rear axle, respectively. A front housing is secured to the bottom surface of the riding platform at the front of the skateboard and a rear housing is secured to the bottom surface of the riding platform at the rear of the skateboard. Each of said housings comprises an illumination source and a power source connected to said illumination source by means of an electrically conducting element such as a wire. A switch means is mounted on the surface of the riding platform and is operable to establish contact between the illumination source and the power source in the front and rear of the skateboard.

BRIEF DESCRIPTION OF THE INVENTION

In the drawings, wherein like reference numerals are employed to designate like parts:

DETAILED DESCRIPTION OF THE INVENTION

Figure 1:
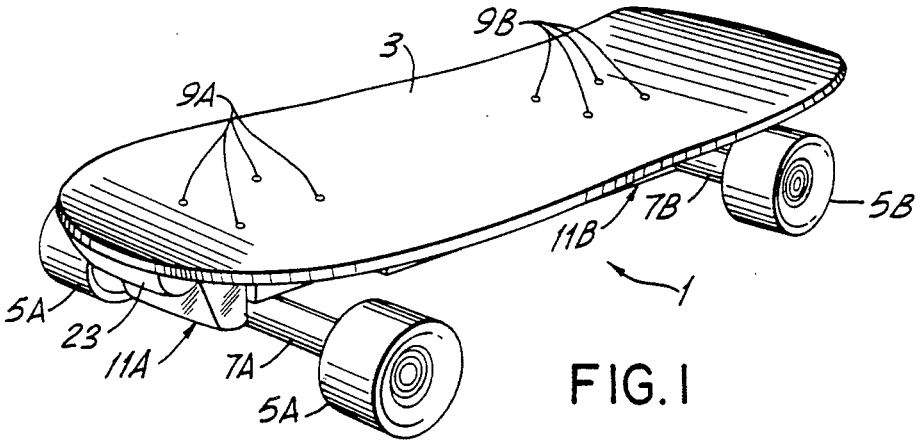
FIG. 1 is a prospective view of a typical skateboard embodying the principles of the present invention.

Referring first to FIG. 1 of the drawings, there is shown a skateboard generally designated as 1 comprising a riding platform 3 a pair of front wheels 5A, 5A and a pair of rear wheels 5B, 5B rotatably mounted about their respective axles 7A, 7B. The platform 3 is provided with front mounting screws 9A and rear mounting screw 9B for securing the platform to the front housing assembly 11A and rear housing assembly 11B as hereinafter described and shown in FIGS. 2 and 3.

Figure 2:
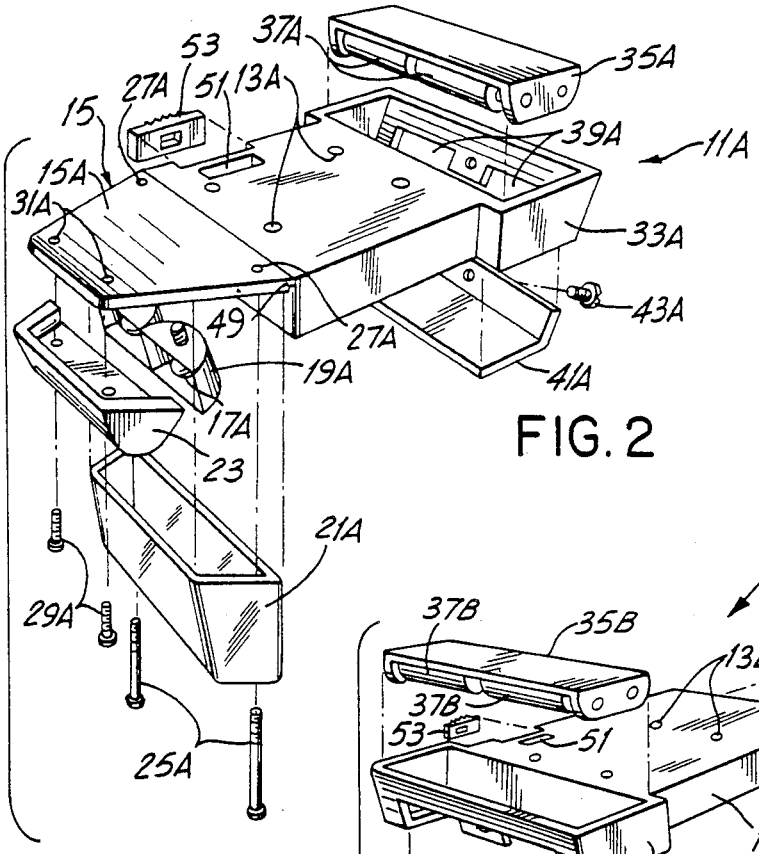
FIG. 2 is an exploded view of the front lights housing assembly at the bottom of the skateboard.
Figure 3:
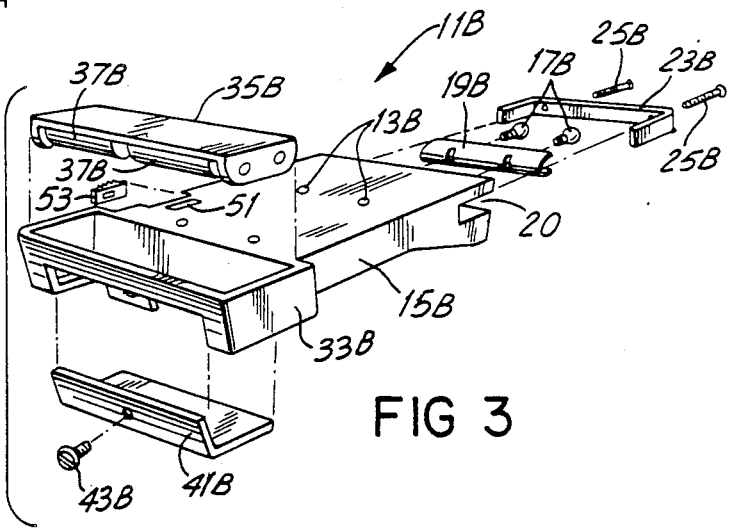
FIG. 3 is an exploded view of the rear lights housing assembly at the bottom of the skateboard.

In FIGS. 2 and 3, there are shown the front housing 11A and rear housing 11B, each provided, respectively, with front mounting holes 13A and rear mounting holes 13B. The front screws 9A and the rear screws 9B may be threaded externally, and the front mounting holes 13A and the rear mounting holes 13B may be threaded internally for threaded engagement of the mounting screws into their respective mounting holes, thereby securing the housings 11A and 11B between the platform 3 and the removable front and rear trucks 45A and 45B as are more clearly shown in FIG. 5. Alternatively, the mounting screws 9A and 9B may be inserted through their corresponding mounting holes 13A and 13B and tightly secured by means of suitable nuts and bolts and thus secure the housings 11A and 11B between the platform 3 and the front and rear removable trucks 45 and 45B (as aforementioned).

Figure 4:
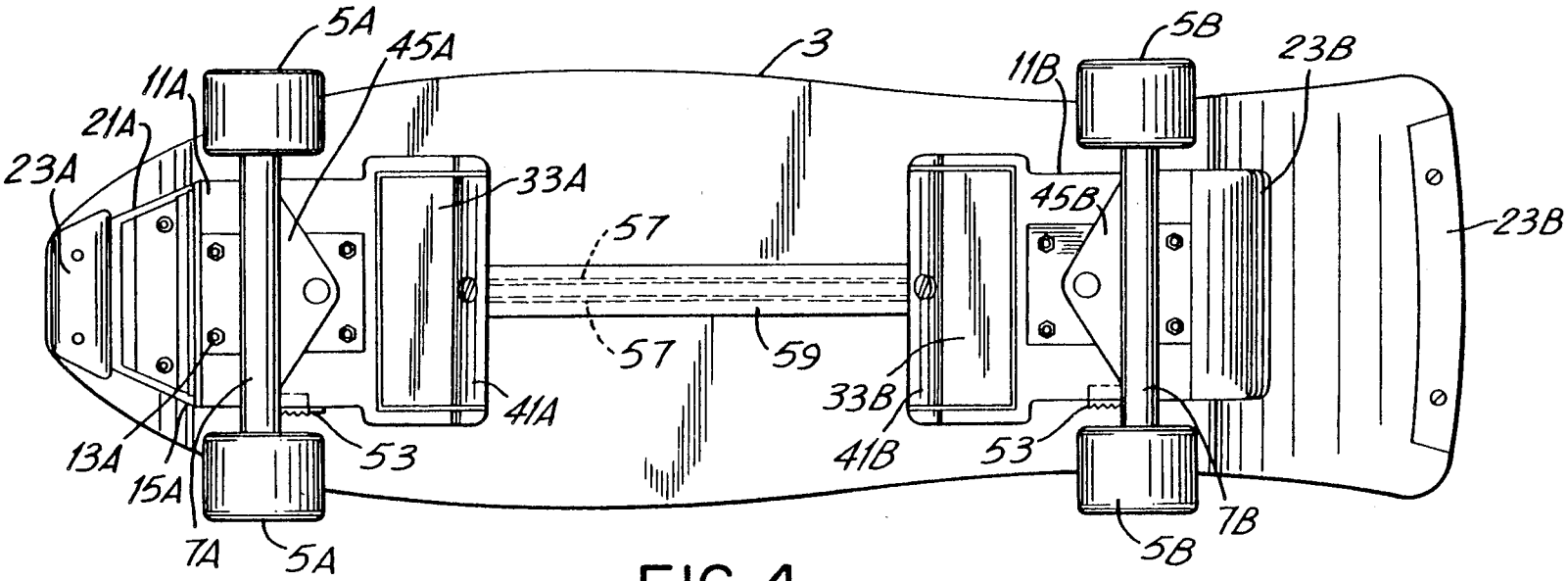
FIG. 4 is a bottom plan view of the skateboard.

Referring now to FIGS. 2 and 4, the front portion of the skateboard is shown equipped with a front lights assembly generally designated as 15 comprising a top flange extension 15A. The front lights assembly 15 comprises one or more light bulbs 17A mounted within a reflector 19A which is disposed within the front lights assembly cover 21A. A shock absorbing material is placed between the reflector and the assembly cover 21A to protect the light bulbs 17A.

The front edge of the platform 3 is protected against damage due to collision by the bumper guard 23A which can be gripped by the rider for manipulating the skateboard. The bumper guard may be designed to completely enshroud the lights assembly. The front lights assembly cover 21A is secured to the flange 15A of the front housing 11A by means of the externally threaded screws 25A which engage the internally threaded holes 27A drilled through the rear portion of the flange 15A. Similarly, the bumper guard 23A is secured to the front edge of the flange 15A by means of the externally threaded screws 29A which engage the internally threaded holes 31A drilled in the front portion of the flange 15A.

As is further shown in FIG. 2, the front housing 11A includes a molded battery holder compartment 33A for receiving the battery holder/cover 35A. The battery holder/cover 35A is adapted to snap into engagement with the battery holder compartment receiver 33A, or it may be pressure fitted or attached thereto by any other suitable means. The battery holder/cover 35A includes recesses (not shown) for securely holding two pairs of batteries such as the batteries 37A, 37A which fit into the recess 39A, for securely holding the batteries in the battery holder compartment 33A when the battery holder/cover 35A is snapped into engagement within the compartment 33A. The batteries may be of conventional type such as the batteries used to energize household flashlights. A removable front battery door cover 41A fits on the underside of the compartment 33A and covers the lower exposed portion of the batter holder/cover 35A to protect the batteries and to provide access thereto. The cover 41A may be secured to the compartment 33A by means of the screws 43A as shown in FIG. 2.

Figure 5:
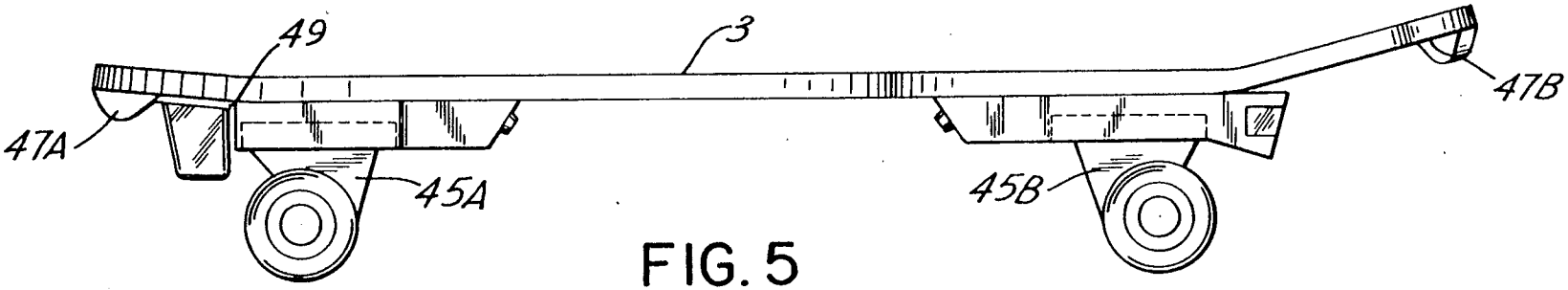
FIG. 5 is a side view of the skateboard.

In FIGS. 3–5, the rear portion of the skateboard 1 is shown comprising a rear housing 11B which is held between the platform 3 and the rear removable truck 45B by means of the rear mounting screws 9B which engage the rear mounting holes 13B as aforesaid. The rear housing 11B comprises the rear lights assembly 15B which comprises one or more illuminating bulbs 17B mounted in the reflector 19B which fits into the conforming recess 20 in the rear of the housing 11B. The rear edge of the housing 11B protects the recessed rear lenses of the skateboard from damage due to collision. The rear lens cover 23B which protects the light bulbs 17B is secured to the rear housing 11B by means of the externally threaded screws 25B which pass through aligned apertures in the lens cover 23B and the reflector 19B, and engage internally threaded holes (not shown) in the face surface of the recess 20.

At its rear portion, the rear housing 11B includes the molded battery holder compartment 33B which is of similar general construction as the compartment 33A in the front assembly of the skateboard. The compartment 33B receives the battery holder/cover 35B by pressure fitting or snapping engagement of the battery holder/cover 35B into the compartment 33B. As in the front section, the battery holder/cover 35B includes recessed portions for securely holding two pairs of batteries such as the batteries 37B, 37B which fit into the recess 39B, of the compartment 33B. As in the front batteries, the rear batteries may be of conventional type and variety such as the batteries used in household flashlights. A removable rear battery door cover 41B is attached to the compartment 33B (such as by the screws 43B) as shown in FIG. 3 and protects the batteries 37B, 37B as well as provides access thereto.

Referring to FIG. 5, a hand grip 47A made of a resilient material is securely mounted at the bottom front of the platform 3 and another hand grip 47B made of a similar material is attached to the bottom rear of said platform. A flexible joint 49 formed from a thinned section of the front housing 11A bridges the light assembly to the battery compartment and the platform 3 to allow the housing assembly to conform to the contour of the platform when a person rides thereon.

Figure 6A:
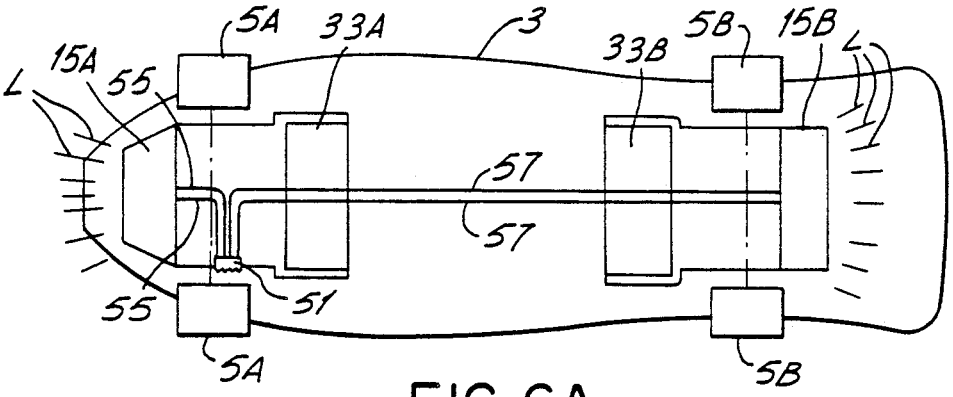
FIG. 6A is a simplified bottom view of the skateboard illustrating one type of switch means used to illuminate the front and rear of the skateboard of this invention.

Referring to FIGS. 2 and 4, and to FIG. 6A, there are shown a sliding switch 51 having a switch cover 53 located in the front housing 11A. As is further illustrated in FIG. 6A, a pair of conductive wires 55, 55 establish electrical connection between the switch 51 and the front lights 17A which, when energized by the batteries 37A, 37A, issue light beams L thereby making the ground visible to the rider in the dark. A second pair of conductive wires 57, 57 establish electrical contact between the switch 51 and the rear lights 17B which causes rearward light beams to issue from the rear of the skateboard and hence enhance its visibility from the rear and make it visible to others. The wires 55, 55 and 57, 57 are conveniently sheathed with the protected covers 59 (shown for the rear wire connections 57, 57 in FIG. 4).

Figure 6B:
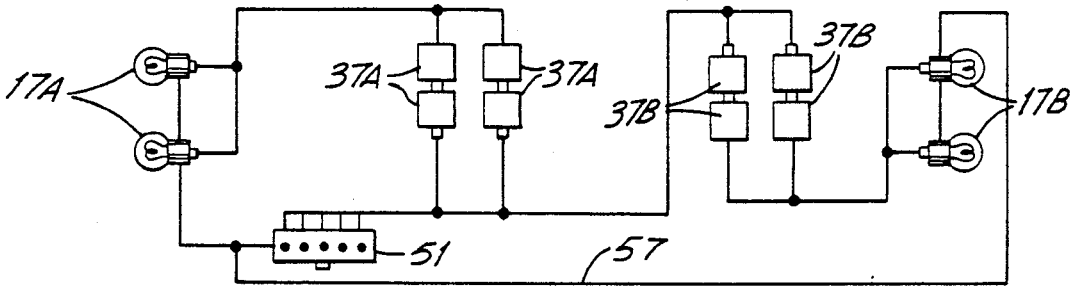
FIG. 6B is an electrical circuit diagram for the switch/lights assembly used in the embodiment illustrated by FIG. 6A.

Referring to FIG. 6B, the sliding switch 51 may be activated to illuminate the lights by simply sliding the switch to the "front" indicator, "front and rear" indicator, "rear" indicator or to the "flashing rear" indicator, as desired.

Figure 7A:
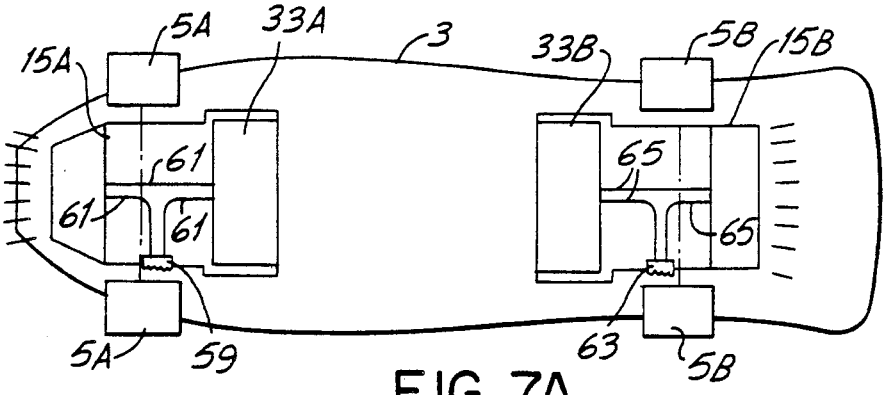
FIG. 7A is a simplified bottom view of the skateboard having separate front and rear switches for illuminating the front and rear portions of the skateboard, respectively.

FIG. 7A is similar to FIG. 6A except that two separate and independent switches with their corresponding separate electrical circuits are used to illuminate the front and rear lights, respectively. Thus, as shown in FIG. 7A, a sliding switch 59 is installed at the front bottom surface of the riding platform 3. The pair of wires 61, 61 establish electrical connection between the switch 59 and the front lights 17A in the front light housing assembly 11A and the batteries in the front battery compartment 33A when the switch is in the "on" position (see FIG. 7B). Thus, when the lights 17A are energized by turning the switch 59 to the "on" position, the front light beams illuminate the front of the skateboard.

A similar switch assembly is provided at the rear of the skateboard. Thus, the rear bottom surface of the riding platform 3 is equipped with a sliding switch 63 and a pair of wires 65, 65 (which may be sheathed) establish electrical connection between the rear lights 17B in the rear light housing assembly 15B and the batteries located in the rear battery compartment 33B. Thus, by turning the switch 63 to the "on" position, the rear lights 17B illuminate the rear of the skateboard.

Figure 7B:
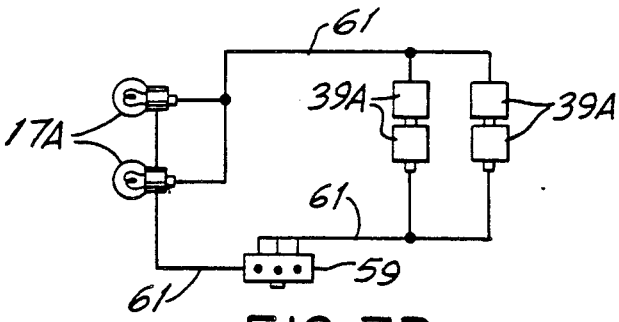
FIG. 7B is an electrical circuit diagram for each of the switch/lights assembly in FIG. 7A.

FIG. 7B is a schematic diagram of the electrical connection between the lights and the batteries for the front of the skateboard, (the rear diagram being identical except for reversing the positions of the lights and batteries.) The switch 59 may be activated to the "on" position to illuminate the front lights 17A, or it may be turned to the "flash" position in order to generate flashing signals, as desired. The rear lights 17B may be turned "on" or "flash" by turning the rear switch 63 as desired.

In the embodiment illustrated in FIG. **8*a*, the rotatable switch 67 having a rotatable knob 69 is mounted on the top surface of the riding platform 3. The pair of wires 71, 71 establish electrical connection between the front lights 17A and front batteries 39A and also between the rear lights 17B and rear batteries 39B. As in FIGS. 6A and 7A, the wires 71, 71** may be sheathed to protect the wires from mechanical damage.

Figure 8A:
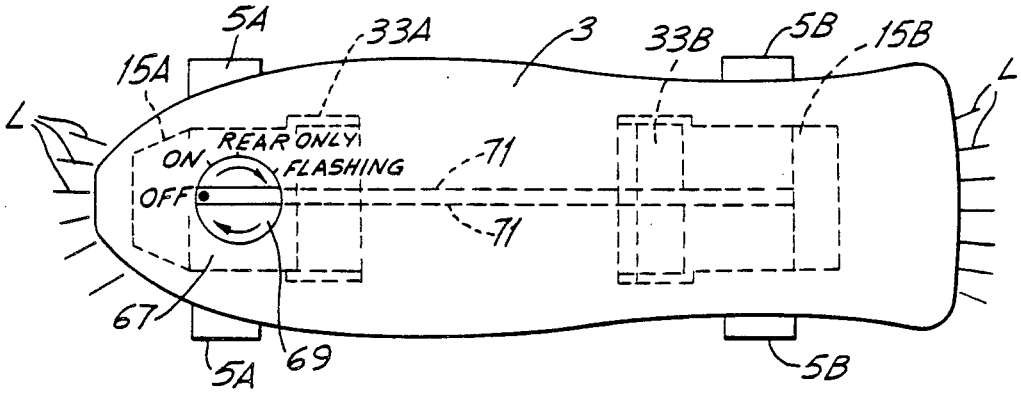
FIG. 8 is a simplified top view of the skateboard with a rotating switch for illuminating both the front and rear of the skateboard.
FIG. 8B is an electrical circuit diagram for the switch/light assembly shown in FIG. 8.
Figure 8B:
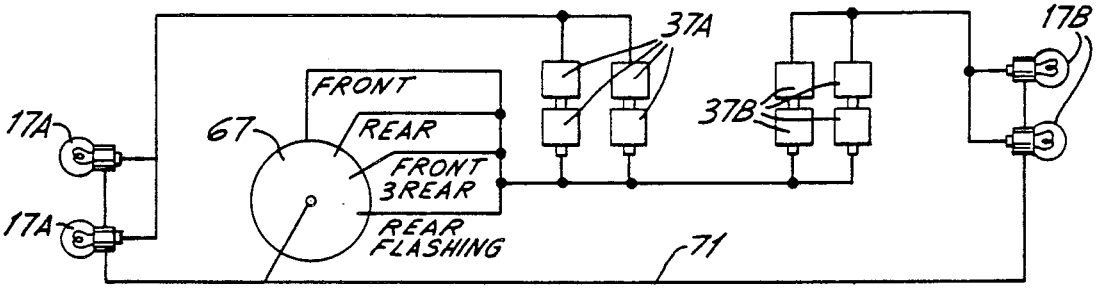

Referring to FIG. 8B, the rotatable knob 69 may be turned to any of the indicated positions, i.e., "front", "rear", "front and rear" or "rear flash" to illuminate the appropriate light bulbs 17A, 17A or 17B, 17B or both.

The circuitries illustrated in FIG. 6A, 7A, 7B and 8A are themselves generally known to those skilled in the art and do not require detailed explanation or description.

We claim:

1. An illuminated skateboard comprising, in combination:

(a) a riding platform having a top riding surface and a bottom surface;

(b) wheels depending from said bottom surface and rotatable about their respective axles;

(c) a front truck member;

(d) a front housing secured between said platform and said front truck member;

(e) a rear truck member;

(f) a rear housing secured between said platform and said rear truck member;

(g) a front illumination assembly in said front housing, said front illumination assembly comprising a reflector member within which is mounted a front illumination source; and (h) a rear illumination assembly in said rear housing; said rear illumination assembly comprising a reflector member within which is mounted a rear illumination source.

2. An illuminated skateboard as in claim 1 wherein said front housing comprises at least one illumination source and at least one power source, said rear housing comprising at least one illumination source and at least one power source, means for establishing electrical communications between each of said illumination sources and its respective power source, and switch means operable to activate said means for establishing said-electrical communication.

3. An illuminated skateboard as in claim 2 wherein said illumination source in the rear housing is a flashing light source.

4. An illuminated skate board as in claim 2 wherein said power sources are batteries.

5. An illuminated skateboard as in claim 2, 3 or 4 wherein said means for establishing electrical communication between each of said illumination source and each of said power sources is an electrically conductive wire.

6. An illuminated skateboard as in claim 2 wherein said switch means is a rotatable switch secured to the top surface of said riding platform.

* * * * *